United States Patent [19]

Motta et al.

[11] 4,443,939

[45] Apr. 24, 1984

[54] FLEXIBLE RAZOR BLADE CARTRIDGE

[75] Inventors: Vincent C. Motta, West Norwalk; Ernest F. Kiraly, Fairfield, both of Conn.

[73] Assignee: Warner-Lambert Company, Morris Plains, N.J.

[21] Appl. No.: 373,365

[22] Filed: Apr. 30, 1982

[51] Int. Cl.[3] ..... B26B 21/14

[52] U.S. Cl. ..... 30/49; 30/47; 30/50; 30/81; 30/83

[58] Field of Search ..... 30/47, 49, 59, 79, 80, 30/81, 82, 83, 50, 60.5

[56] References Cited

U.S. PATENT DOCUMENTS

| | | | |
|---|---|---|---|
| 3,783,510 | 1/1974 | Dawidowicz et al. | 30/47 |
| 4,069,580 | 1/1978 | Cartwright et al. | 30/47 |
| 4,146,958 | 3/1979 | Chen et al. | 30/47 |

*Primary Examiner*—E. R. Kazenske
*Assistant Examiner*—Willmon Fridie, Jr.
*Attorney, Agent, or Firm*—R. S. Strickler

[57] ABSTRACT

A flexible razor blade cartridge having an expansible cap plus a blade support composed of a plurality of contiguous sinews or ribbons of flexible plastic material defining a sinuous, convoluted, cage-like structure including an integral segmental flexible guard bar and means for releasably securing the cartridge to a handle.

7 Claims, 15 Drawing Figures

FIG.4
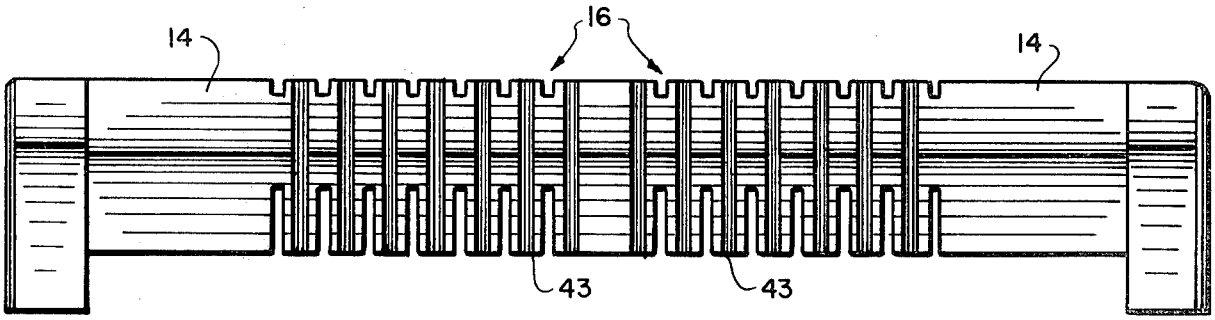
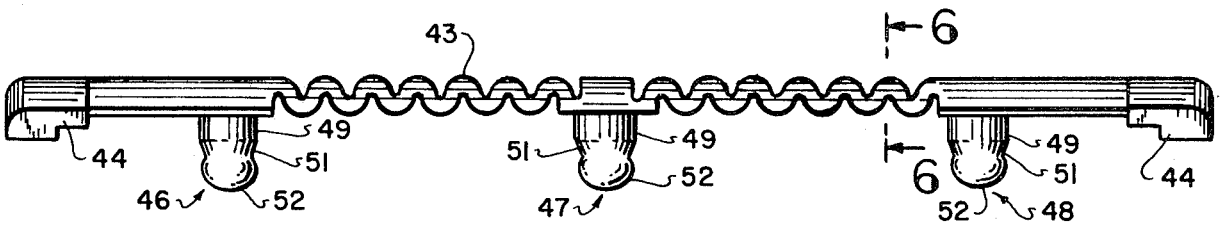
FIG.5
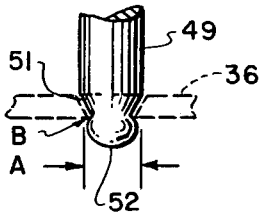
FIG.5A
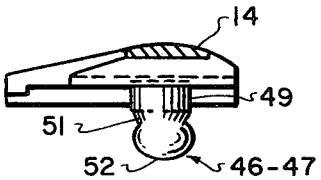
FIG.6
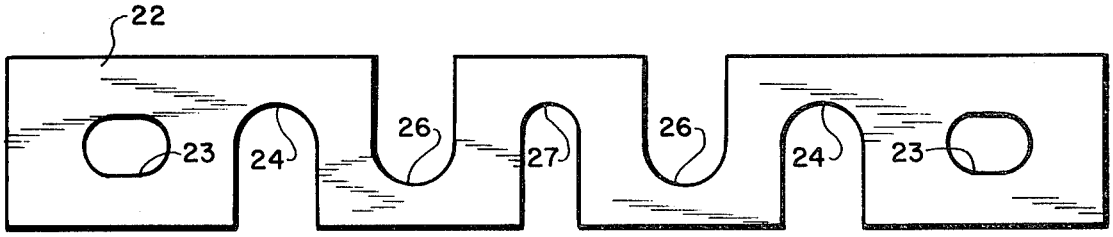
FIG.7

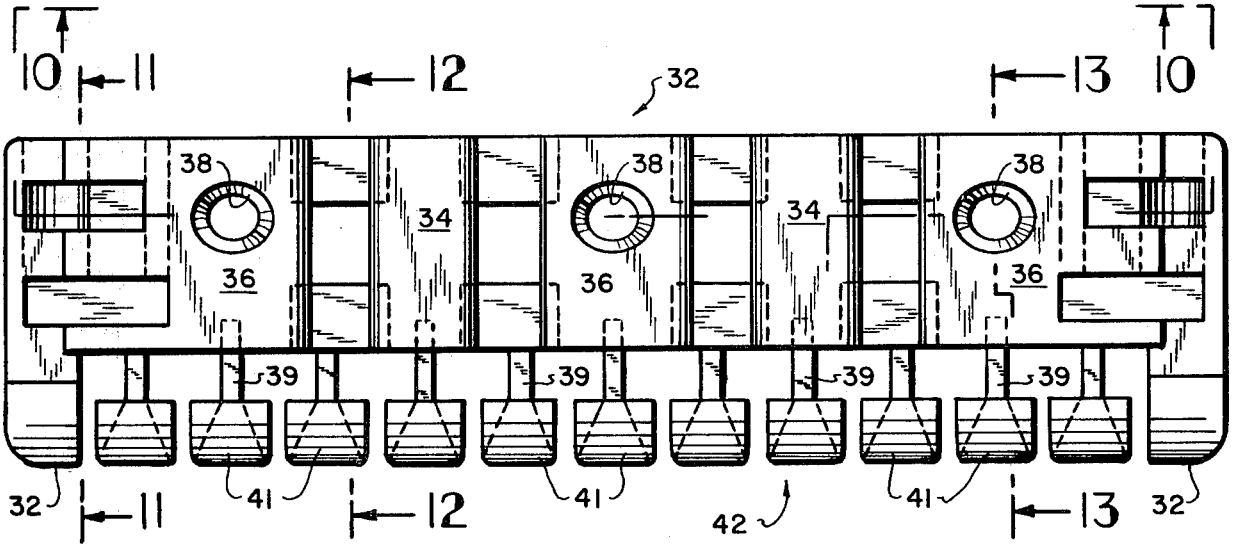
FIG.8
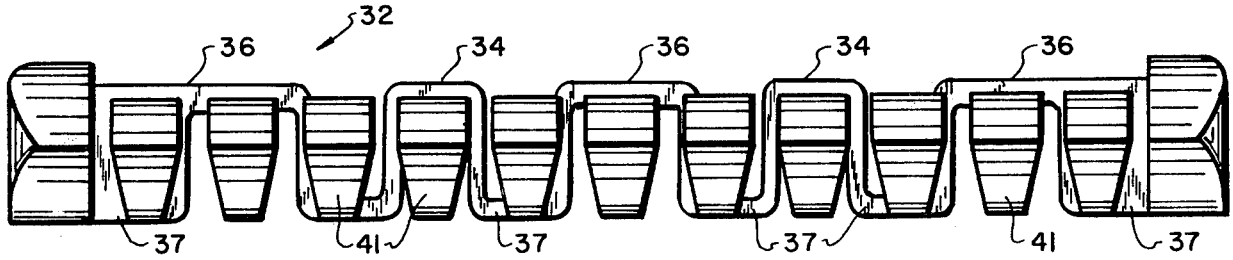
FIG.9
FIG.10
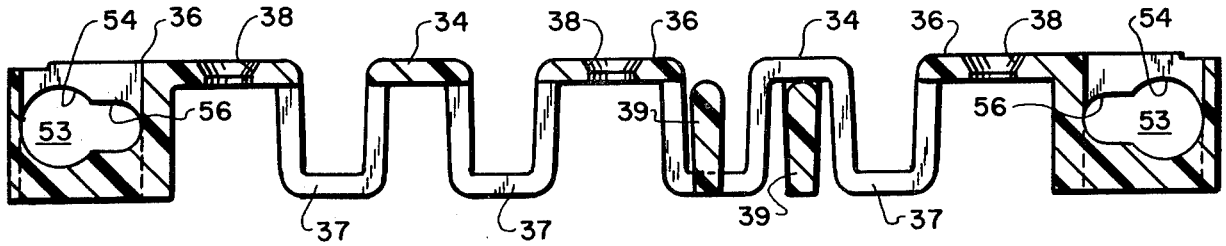

FLEXIBLE RAZOR BLADE CARTRIDGE

BACKGROUND OF THE INVENTION

The present invention deals with wet razors and, in particular, relates to so-called razor cartridges in which one or more razor blades, each having a single cutting edge, are packaged securely and permanently into a unitary assembly.

Usually the cartridge is formed with a track, journals or other suitable elements to make a separable connection with a handle.

Such prior art cartridges disclosed typically in U.S. Pat. No. 3,783,510 include a rigid, usually plastic, blade seat 13 and a rigid cap 12 sandwiching one or more blades 14–15 and a blade spacer 16, where appropriate, all rigidly secured together by rivets 38 through 41 to develop an inflexible rigid package.

An additional prior art device over which the present invention is an improvement is disclosed in U.S. Pat. No. Re. 30,913 issued Apr. 27, 1982.

In this disclosure, a package of flexible elements, namely, a blade seat 11, first blade 13, spacer 15, second blade 17, and a cap 19 are all secured together by layers or strips of adhesive 12, 14, 16 and 18. In an alternative embodiment of the '913 disclosure, a cartridge element 60 is molded into a single piece-part, i.e., seat 61, guard bar 62 and cap 63 together define one piece with slots 65 and 66 for the reception of blades.

SUMMARY OF THE INVENTION

In contrast to the prior art, the present invention deals with a novel flexible cartridge structure and a correspondingly novel means for connecting the cartridge to a handle.

A special feature of the invention is the provision of a blade package that is flexible with minimal fixed contact among elements of the package, i.e., blade cap or cover, blade, spacer (if more than one blade is utilized) and a blade support are combined into a unitary assembly without the need for layers of adhesive, resin or other binders, where the whole assembly deflects in response to shaving forces.

A further feature of the invention is the means for pinning the elements of the assembly together to generate a flexible unit.

The invention also features a novel "universal joint" connection between the blade assembly or cartridge and the handle which accommodates the tendency of the cartridge to flex during shaving.

A further feature of the invention is the provision of a flexible razor blade cartridge including one or more blades where the blade package or cartridge is secured together without the use of adhesive or the need to "upset" rivets.

It is a further feature of the invention to provide a blade seat defining a flexible cage-like structure and a cooperating expansive blade cap or cover which expands or contracts in the fashion of an accordian.

A blade cartridge embracing certain features of the present invention may comprise a blade seat or blade support composed of a plurality of contiguous sinews or ribbons of flexible plastic material defining a sinuous cage-like structure including a plurality of contiguous projections of generally equal length defining a segmental guard bar, the ribbons of said blade support forming a planar surface for receiving and supporting one or more blades and an accordian-like blade cap including means for securing the blade support, blade or blades, and the cap together.

The language "blade or blade edge" as used in this specification and appended claims is intended to include one or more blades with an appropriate spacer where two blades are used.

Other features and advantages of the present invention will become apparent from an examination of the succeeding specification when read in conjunction with the appended drawings, in which;

BRIEF DESCRIPTION OF THE DRAWINGS

FIG. 4 is a plan view of the cartridge cap;

FIG. 5 is a front elevation of the cap;

FIG. 5A is a schematic showing the method and means for securing the cartridge elements together;

FIG. 6 is a sectional view of FIG. 5 in the plane of line 6—6 as viewed in the direction of the arrows;

FIG. 7 is a plan view of the blade spacer;

FIG. 8 is a plan view of the blade seat;

FIG. 9 is a front elevation of the blade seat;

FIG. 10 is a vertical section of FIG. 8 along offset line 10—10 as viewed in the direction of the arrows;

DESCRIPTION OF PREFERRED EMBODIMENT

Figure 1:
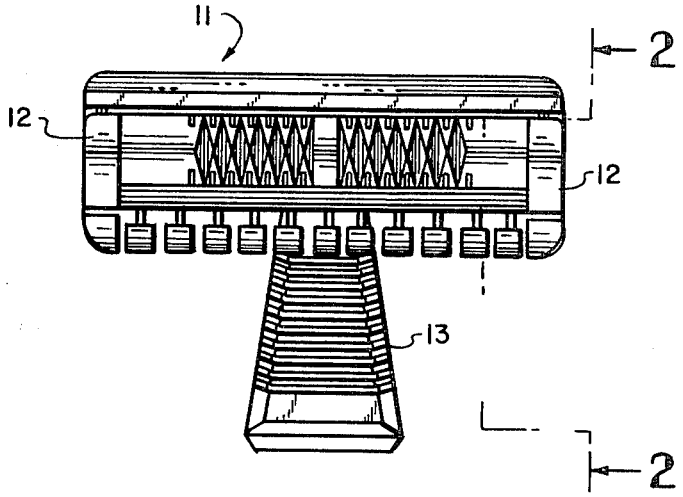
FIG. 1 is a top plan view of a razor constructed in accordance with the principles of this invention.
Figure 2:
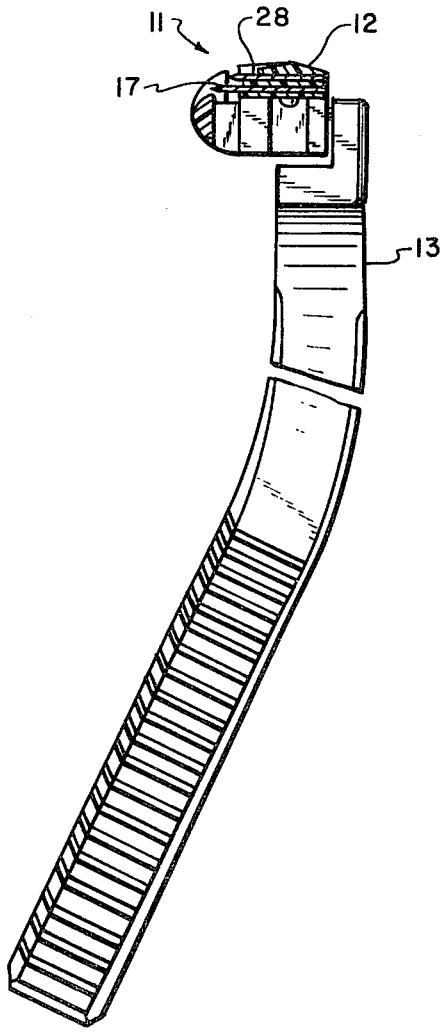
FIG. 2 is an elevational view of the right side of FIG. 1.

Referring now in detail to the drawings, the reference numeral 11 in FIGS. 1 and 2 indicates a razor with a flexible blade cartridge 12 and a handle 13 constructed in accordance with the principles of the invention.

Figure 3:
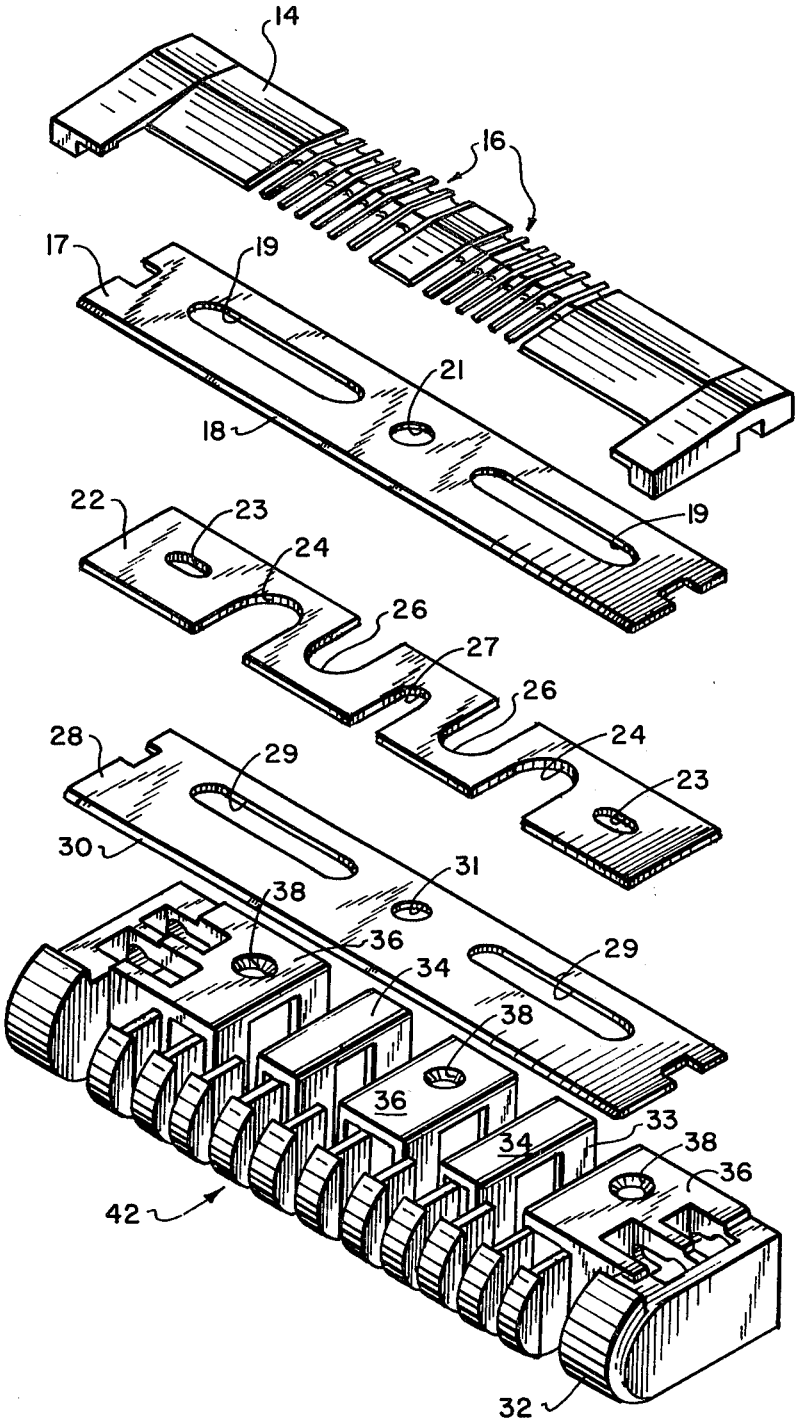
FIG. 3 is an exploded view showing the elements of the flexible blade cartridge.

As is most apparent in FIG. 3, the flexible cartridge elements includes a plastic cap 14 having a central section 16 which has what can be termed a "corrugated" structure permitting the cap to change its end-to-end dimension by extension and contraction in the fashion of a bellows or an accordian.

Next below the cap or cover 14 is a first or top metal blade 17 having a cutting edge 18, elongated openings 19—19 and a central bore 21.

Below the first blade 17 is a spacer 22 (preferably of plastic) having a pair of spaced oval openings 23—23 and alternating U-shaped cut-outs 24—24 and 26—26 straddling a central smaller cut-out 27.

Next in sequence is a second or lower metallic blade 28 having elongated openings 29—29, a cutting edge 30 and a central bore 31.

The bottom element is a plastic blade support 32 having a generally sinusoidal (rectangular sine wave) body 33 (see FIG. 10) with top sinews or ribbons 34—34 and 36—36 providing a generally planar blade seat and bottom or exterior ribbons 37—37 (see FIG. 10) completing the generally cage-like, convoluted structure.

Top ribbons 36—36 are formed with apertures 38—38 for facilitating assembly of the flexible cartridge, as will be more apparent as the specification proceeds.

Individual to and projecting from each ribbon (top and bottom 34—34, 36—36 and 37—37) are T-shaped protuberances defining narrow fins or webs 39—39 (see FIGS. 8, 9 and 10) each terminating in smooth guard bar segments 41—41 which together form a flexible, segmental guard bar indicated generally at 42.

Details of plastic cap 14 in FIGS. 4, 5 and 6 include said central extensible section 16 having corrugations 43, flat shoulders 44—44 and fastening pins 46, 47 and 48.

Each fastening pin, molded integrally with the plastic cap 14, includes a cylindrical base 49, contiguous frustoconic section 51 terminating in a segment of a sphere 52 to define a novel pin design useful to secure the flexible cartridge elements into a unitary assembly permanently without the need for upsetting the pins or the application of adhesive and the like as is the case with prior art securing means.

A paramount feature of this pin structure and its cooperation with the blade seat or blade support 32 in securing the assembly is that there is a minimum of undesirable distortion and, thus, less warping, stress, cracking and creep among the cartridge elements in contrast to the high degree of distortion that is encountered in other fastening methods such as upsetting rivets or pins in prior art assemblies.

Referring in more detail to FIGS. 8, 9 and 10, note that the apertures 38—38 of the blade support 32 are chamfered to receive the pins 46, 47 and 48 in a manner that will be more apparent when the assembly steps are described.

In FIG. 10, note that the back side of the blade support is formed with two keyhole-shaped openings 53—53 having outer enlarged opening 54—54 blending into smaller inner opening 56—56.

These openings provide access for the reception of cartridge mounting pins 57—57 (see FIGS. 14 and 15) to connect the assembled flexible cartridge to handle 13.

Figure 11:
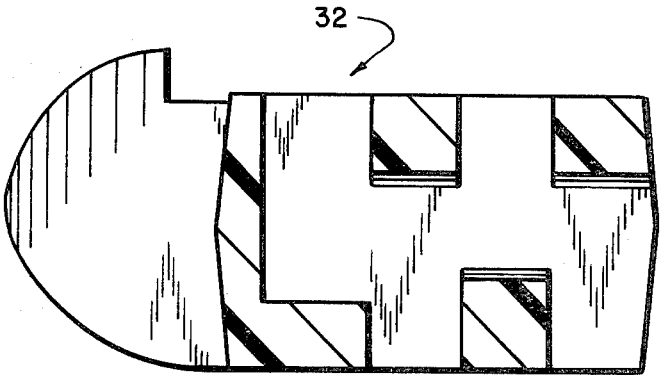
FIG. 11 is a vertical section of FIG. 8 in the plane of the line 11—11 observed in the direction of the arrows.
Figure 12:
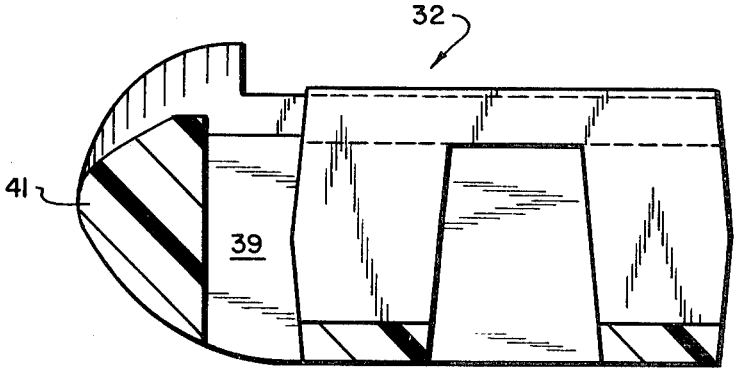
FIG. 12 is a vertical section of FIG. 8 in the plane of line 12—12 viewed in the direction of the arrows.
Figure 13:
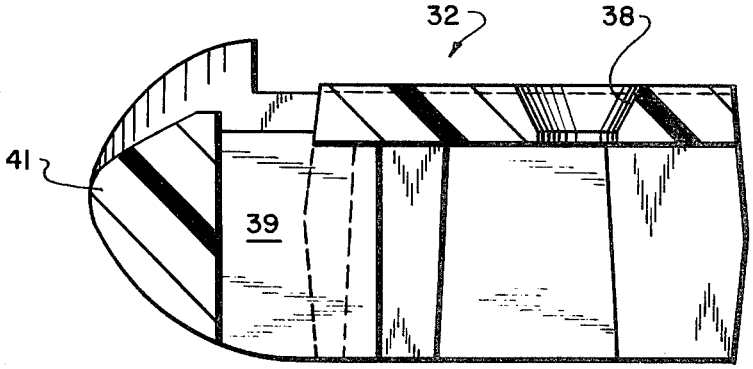
FIG. 13 is an additional section of FIG. 8 in the plane of line 13—13 viewed in the direction of the arrows.

FIGS. 11, 12 and 13 show further details of the blade support body to provide a full understanding of the convoluted arrangement of ribbons or sinews of plastic defining the body structure.

Figure 14:
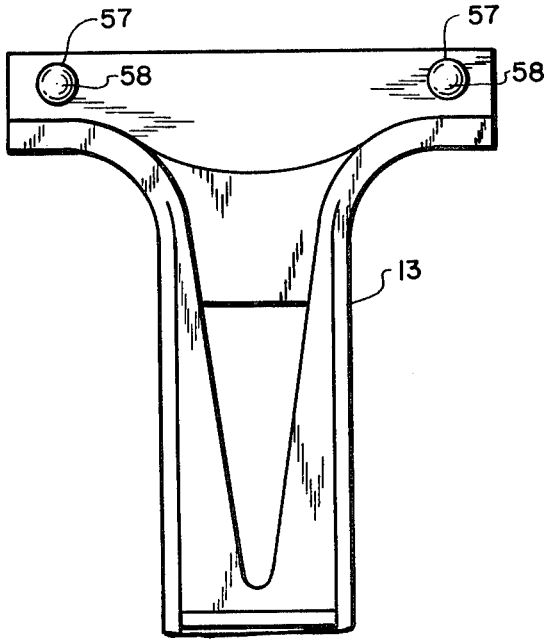
FIGS. 14 and 15 show a representative handle arrangement for a flexible razor embracing principles of the present invention.
Figure 15:
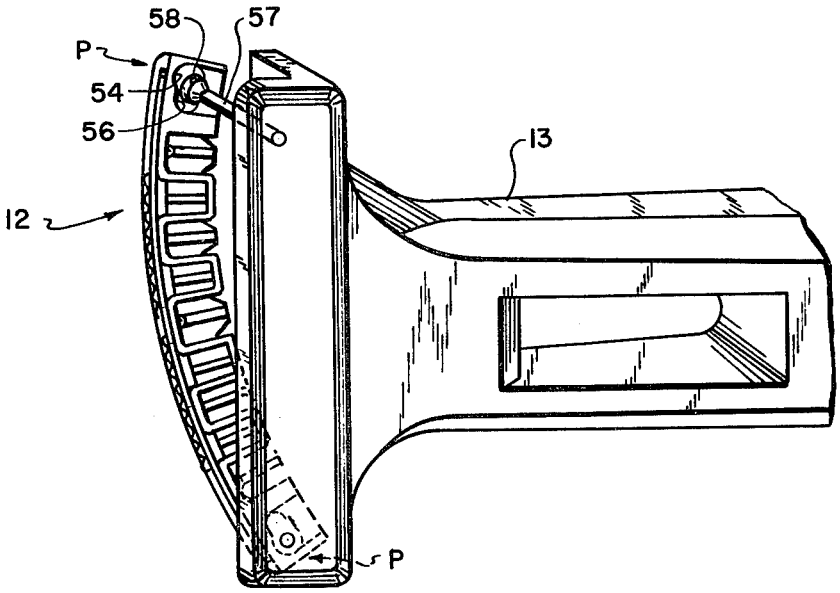

FIGS. 14 and 15 show the upper portion of the razor handle 13 and one method of attaching the razor cartridge to the handle.

Pins 57—57 terminate in spheres or bulbous ends 58—58 sized to fit into the enlarged opening 54 of keyhole slots 53.

As is most apparent in FIG. 15, the connection is accomplished by utilizing the surprising flexibility of the cartridge as follows:

A first end of the cartridge is connected to the handle by introducing the right (FIG. 15) sphere into the mating large opening 54 of the right end of the cartridge.

Thereafter the cartridge is shifted slightly to the right so that the shank or pin 57 is received into smaller keyhole opening 56.

Taking advantage of the inherent flexibility of the cartridge, slight pressure P at the extreme ends of the cartridge 12 in the direction of the arrows of FIG. 15 bows the cartridge outwardly until the large opening 54 of left keyhole slot 53 moves into register with the mating sphere 58.

The left end of the cartridge is then moved toward the razor handle so that the sphere enters the large opening; upon release of the pressure P the cartridge relaxes and expands and the pin 57 moves into the smaller opening 56 to make a separable connection with the handle 13. The razor is now in condition for wet shaving. The cartridge can be removed from the handle by reversing the above steps.

The flexible razor cartridge of the present invention is assembled in the following fashion:

With the cap 14 supported on a suitable surface with the pins 46, 47 and 48 projecting upwardly, blade 17 is dropped upon the cap so that the edge 18 projects as indicated in the exploded view of FIG. 3. Cooperation between slots 19—19 and the outer pins align the blade properly.

Next spacer 22 is positioned upon blade 17 with center pin 47 cooperating with central slot 27 to align the spacer transversely.

Thereafter blade 28 is positioned upon the spacer aligned in the same manner as blade 17.

Finally blade support 32 is disposed over the assembly and when apertures 38—38 are in register with pins 46, 47 and 48 the support 32 is pressed down upon the blade stack. The inner diameter of the apertures 38—38 are dimensioned slightly less than the dimension B (see FIG. 5A). Thus, in receiving the spheres 52—52, of slightly larger diameter A, the apertures expand momentarily while passing over the body of the spheres 52—52 and subsequently "snap" (return) to their normal inner diameter (with a slight interference fit) while making a positive connection with a tight, snug fit around each pin. The fit occurs in the region of the junction of the frustoconic section and the sphere. In this fashion, the cartridge elements are combined into a compact yet flexible unitary assembly overcoming the necessity for riveting, welding, upsetting or the use of adhesive as in prior art arrangements.

What is claimed is:

1. A flexible blade package or cartridge for wet shaving comprising a plastic blade support, one or more blades, and a cap, said blade support defining a sinuous cage-like structure composed of a plurality of contiguous sinews, ribs or ribbons, said blade support having a segmented guard bar projecting therefrom, said support having a planar surface for receiving and supporting one or more blades, said cap being formed with pin means making a snap fit with the blade support for securing the cartridge into a unitary assembly and said cage-like structure defining generally a sine wave.

2. The flexible cartridge of claim 1 in which a plurality of fins are molded integrally to the sine wave structure, each fin terminating in an individual guard bar segment.

3. The flexible cartridge of claim 2 in which the individual guard bar segments collectively define a flexible guard bar.

4. The flexible cartridge of claim 1 in which the sine wave is generally rectangular in configuration having generally flat positive and negative apices.

5. The flexible cartridge of claim 4 in which a fin is molded integrally and individually to each flat apex, each fin terminating in a guard bar segment.

6. The flexible cartridge of claim 1 in which the cap is formed with a plurality of flexible corrugations to render the cap freely deflectable.

7. The flexible cartridge of claim 6 in which the corrugations of the cap are disposed in two groups, each group being bounded by a pair of pin means.

* * * * *